US010119788B2

(12) United States Patent
Kennair, Jr.

(10) Patent No.: US 10,119,788 B2
(45) Date of Patent: Nov. 6, 2018

(54) TACTICAL-GEAR RAIL-MOUNTING SYSTEM APPARATUS AND METHOD

(71) Applicant: Donald Kennair, Jr., Belle Chasse, LA (US)

(72) Inventor: Donald Kennair, Jr., Belle Chasse, LA (US)

( * ) Notice: Subject to any disclaimer, the term of this patent is extended or adjusted under 35 U.S.C. 154(b) by 0 days.

(21) Appl. No.: 15/790,226

(22) Filed: Oct. 23, 2017

(65) Prior Publication Data

US 2018/0066920 A1 Mar. 8, 2018

Related U.S. Application Data

(63) Continuation of application No. 15/013,318, filed on Feb. 2, 2016, now Pat. No. 9,797,688.

(51) Int. Cl.
*F41B 11/00* (2013.01)
*F41G 11/00* (2006.01)

(52) U.S. Cl.
CPC ..... *F41G 11/003* (2013.01)

(58) Field of Classification Search
CPC ..... F16M 13/00; F16M 13/04; F42B 12/44; F41F 7/00; A62C 3/0285
See application file for complete search history.

(56) References Cited

U.S. PATENT DOCUMENTS 2,466,713 A 4/1949 Kraus
2,483,711 A 10/1949 Roos
3,105,430 A 10/1963 Fernelius
D204,911 S 5/1966 Adams
3,434,406 A 3/1969 Anne
4,870,440 A 9/1989 Frost
7,275,529 B2 * 10/2007 Boys ..... F41B 7/00 124/66
7,451,679 B2 * 11/2008 Stevenson ..... A62C 3/0285 102/336
8,316,750 B2 * 11/2012 Toeckes ..... A62C 3/025 124/71
D719,603 S 12/2014 Hurst
9,341,442 B1 5/2016 Geissele
9,423,208 B1 8/2016 Mahmalji
9,546,848 B1 1/2017 Burger, Sr. et al.
9,599,432 B2 3/2017 Neville
9,797,688 B2 * 10/2017 Kennair, Jr. ..... F41G 11/003
2010/0101401 A1 * 4/2010 Toeckes ..... A62C 3/08 89/1.51
2011/0198471 A1 8/2011 Marquez
2013/0180143 A1 7/2013 Delgado Acarreta
2014/0215887 A1 8/2014 Luckey et al.
2014/0283672 A1 * 9/2014 Sparling ..... B64D 1/06 89/1.51

* cited by examiner

*Primary Examiner* — Michael D David
(74) *Attorney, Agent, or Firm* — Keaty Law Firm, LLC

(57) ABSTRACT

A tactical-gear rail-mounting system apparatus and method utilizing the Picatinny-rail standard, allowing precise aligned removable mounting of a variety of tactical gear such as telescopic sights, night vision devices, reflex sights, laser aiming modules, rangefinders, tactical lights, cameras, fore-grips, bipods, and bayonets, in field-interchangeable configurations, to small-arms rifles and pistols and to non-firearm tactical gear, by providing a greater amount of mounting area and a variety of mounting-surface orientations.

2 Claims, 6 Drawing Sheets

TACTICAL-GEAR RAIL-MOUNTING SYSTEM APPARATUS AND METHOD

CROSS-REFERENCE TO RELATED APPLICATIONS

This application is a continuation application of my co-pending application Ser. No. 15/013,318, filed Feb. 2, 2016 on a "TACTICAL-GEAR RAIL-MOUNTING SYSTEM APPARATUS AND METHOD", the full disclosure of which is hereby incorporated by reference herein and priority of which is hereby claimed.

BACKGROUND OF THE INVENTION

The present invention provides a tactical-gear auxiliary equipment rail-mounting system apparatus and method that allows connection of a variety of tactical gear, such as gun stocks, camera supports, sights and rangefinders, grips, and clamps, in field-interchangeable configurations.

The Weaver rail mount was a small-arms manufacturer's apparatus meant to facilitate the removable mounting of telescopic sights on rifles while ensuring proper alignment. With some modifications, the Weaver rail was adopted as a U.S. military standard, the MIL-STD-1913 rail, also known as Picatinny rail, Standardization Agreement (STANAG) 2324 rail, or tactical rail. The NATO Accessory Rail (NAR), also known as Standardization Agreement (STANAG) 4694 rail, is another, very closely related and essentially interchangeable standard, using essentially the same dimensions stated in metric units.

The Picatinny rail provides a standard mounting platform for small arms—rifles and pistols—and consists of rails with angled surfaces for alignment and attachment, and regularly spaced transverse slots allowing screws, bolts, or other connectors to pass underneath the object being mounted. Use of the Picatinny rail is no longer limited to telescopic sights, but also includes mounting auxiliary equipment such as night vision devices, reflex sights, laser aiming modules, tactical lights, cameras, fore-grips, bipods, and bayonets to small arms in both military and non-military uses.

A large and growing amount of auxiliary equipment using the Picatinny-rail system now exists. Just one continuous unit of Picatinny rail is unlikely to be adequate to properly mount all of the auxiliary equipment, because of a lack of total mounting area and because in-line mounting causes some equipment to be ahead or behind other equipment along the line of fire. Even where equipment can be fit onto a single rail by clever arrangement, that clever arrangement is likely to cause complications if any reconfiguration is later needed in the field. Also, some auxiliary equipment is better mounted at some angle to the line of fire.

In some circumstances, only the auxiliary equipment is needed, without any rifle or pistol, such as with cameras, spotting scopes, rangefinders, remotely located equipment, and decoy equipment. Also, in some circumstances, it is not possible or proper to point a firearm toward an object of interest just for the sake of getting a photograph, measurement, or reading. In such circumstances, mounting to Picatinny rails that are not attached to a firearm, but that still provide the properly aligned mounting surfaces, and still allow for the use of stocks, grips, bipods, and the like, is desirable.

There is a need for a rail-mounting system, utilizing the Picatinny-rail standard, that provides a greater amount of mounting area and a variety of mounting-surface orientations, for small-arms and non-firearm tactical gear auxiliary equipment.

SUMMARY OF THE INVENTION

The present invention is a tactical-gear rail-mounting system apparatus and method utilizing the Picatinny-rail standard, allowing precise aligned removable mounting of a variety of tactical gear auxiliary equipment, such as telescopic sights, night vision devices, reflex sights, laser aiming modules, rangefinders, tactical lights, cameras, fore-grips, bipods, and bayonets, in field-interchangeable configurations, to small-arms rifles and pistols and to non-firearm tactical gear, by providing a greater amount of mounting area and a variety of mounting-surface orientations.

This invention solves a problem with precise aligned removable mounting of a growing amount of auxiliary equipment, under field conditions, to small-arms rifles and pistols and to non-firearm tactical gear.

BRIEF DESCRIPTION OF DRAWINGS

Reference will now be made to the drawings, wherein like parts are designated by like numerals, and wherein.

DETAILED DESCRIPTION OF THE INVENTION

Figure 1:
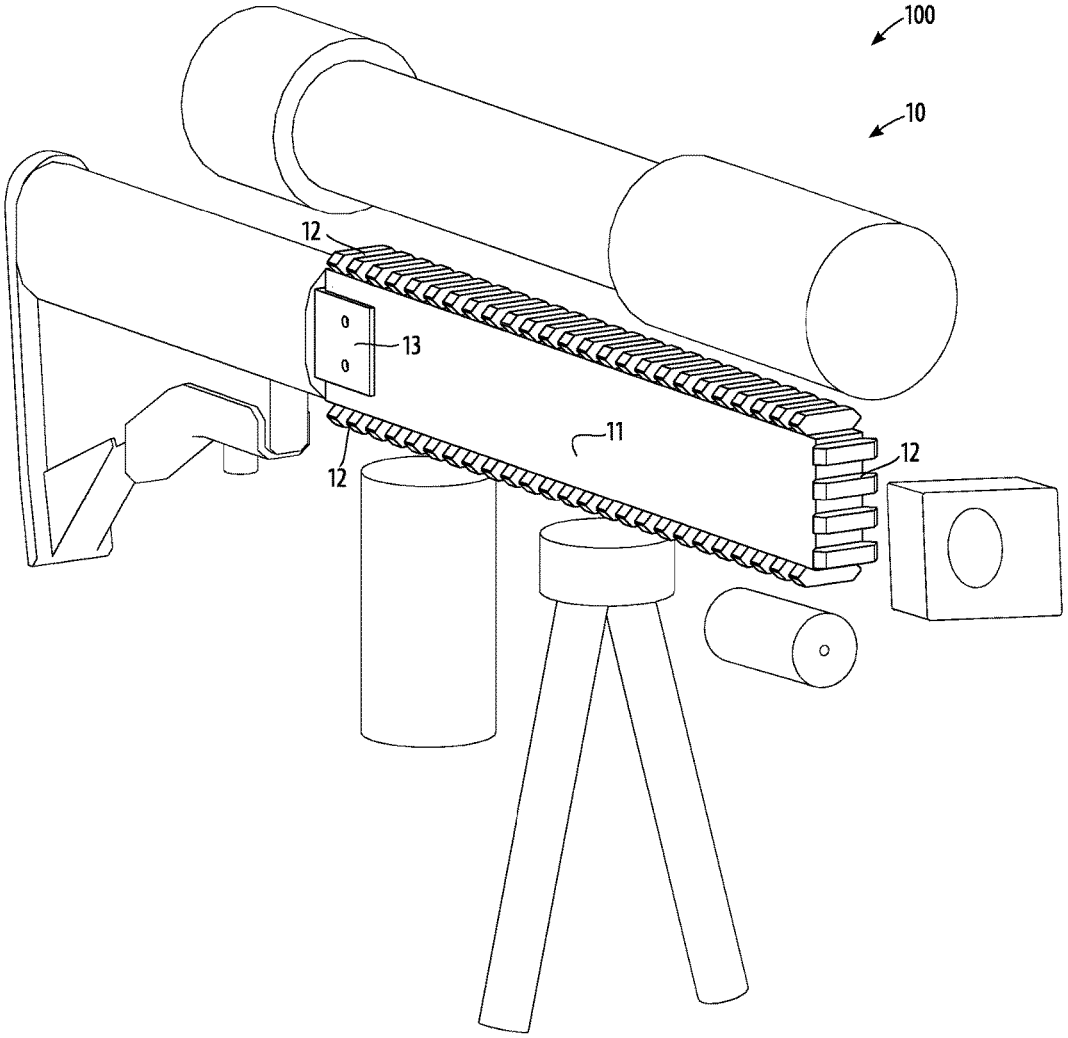
FIG. 1 is a schematic view of the tactical-gear rail-mounting system in use.

Referring to FIG. 1 and the other figures generally, the tactical-gear rail-mounting system method 100 and apparatus 10 are shown schematically in use on a variety of tactical-gear auxiliary equipment. Illustrated schematically is the simultaneous precise aligned removable attachment of a telescopic sight or scope, a camera, a laser-line projector, a bipod, and a grip to my tactical-gear rail-mounting system apparatus which is in turn attached to a rifle-type stock.

The tactical-gear rail-mounting system apparatus 10 has a support body 11 to which is attached more than one rail-connector unit 12. Optionally, an attachment unit 13 in the form of a bracket or clip attaches the support body 11 to other technical gear, such as the stock as shown.

Figure 2:
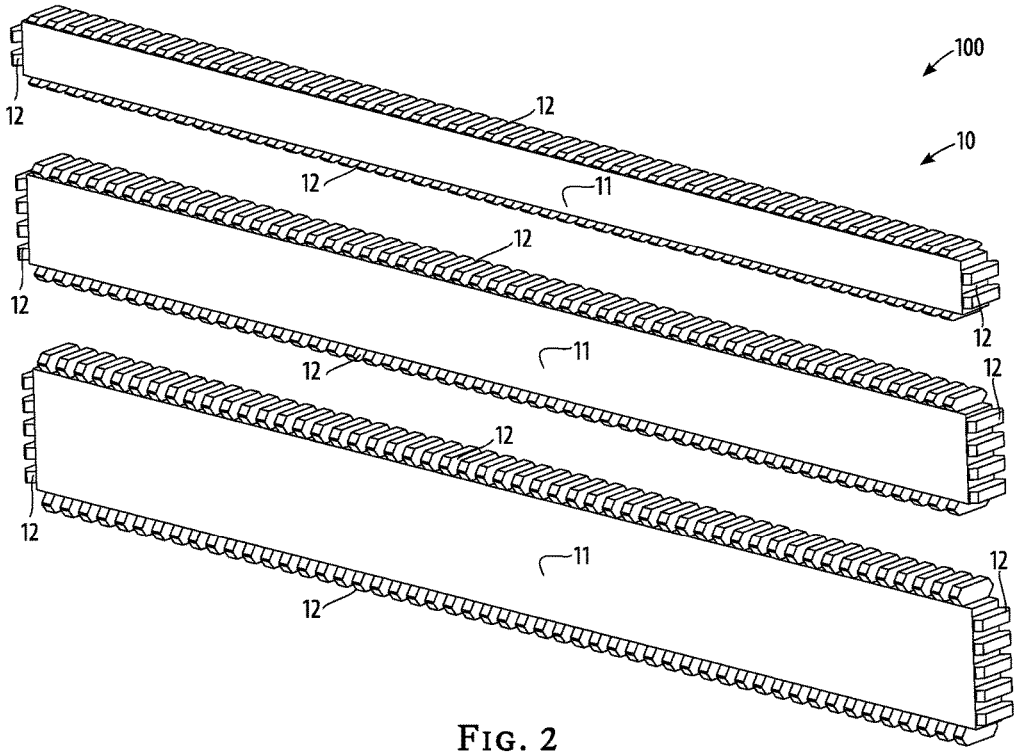
FIG. 2 is an orthographic view of embodiments of the tactical-gear rail-mounting system having different short-side lengths.

Referring now to FIG. 2, the support body 11 has a longer direction and a shorter direction, which together define a simple polygon, generally a long rectangle as shown, but also possibly a triangle, square, pentagon, hexagon, or more, where it is desirable to have edges at angles other than right angles to each other. For special applications, the polygon could be skewed, but normally will define a flat planar structure. If the support body is thought of as a polyhedron, with a nominally forward-facing face, as illustrated, and a corresponding backward-facing face, then there are faces corresponding to each longer edge and each shorter edge, and there is a depth or thickness of the shortest linear distance between the forward- and backward-facing faces. Optimally, this depth or thickness should measure 0.617 of an inch or 15.6 millimeters, and cannot exceed those measurements because those measurements are part of the Picatinny-NATO standards. If the depth of the major part of the support body needs to be greater for some reason, then the depth of the outermost one-eighth or 0.13 of an inch or 3.3 millimeters can be stepped down to the proper depth not greater than 0.617 of an inch or 15.6 millimeters.

More than one rail-connector unit 12 is firmly and permanently or semi-permanently affixed to one of the edge faces of the support body 11 as shown. On a rectangular support body 11, a rail-connector unit 12 running along the top longer edge will be perpendicular to any rail-connector unit 12 running along a side or shorter edge, and parallel with any rail-connector unit 12 running along the bottom longer edge. The bottom surfaces of the rail-connector units 12 will all face at least generally towards each other, and the corresponding top surfaces will all face at least generally away from each other.

Figure 7:
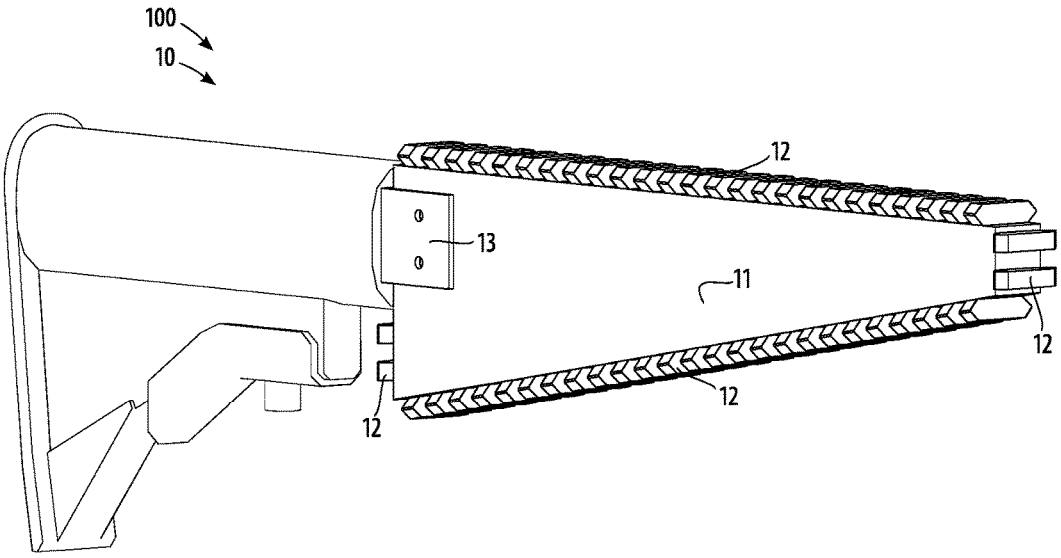
FIG. 7 is an orthographic view of an embodiment of the tactical-gear rail-mounting system having an angled bottom surface.

Referring briefly to FIG. 7, the polygonal shape of the support body 11 can be other than rectangular, and should be if an angled rail-connector unit, as shown, is desired.

Figure 3:
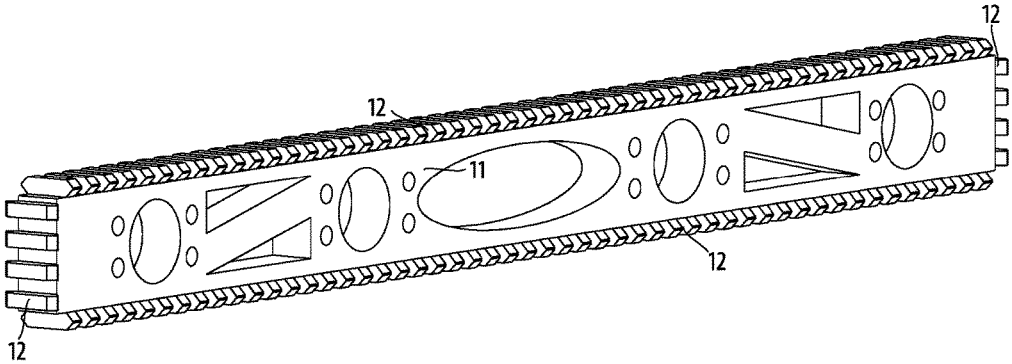
FIG. 3 is an orthographic view of an embodiment of the tactical-gear rail-mounting system having cut-outs in the support body.

Referring now to FIG. 3, the support body 11 can be provided with cut-out portions in order to decrease the weight, wind-catching characteristics, or other characteristics of the support body. This cut-out area could be used to house or store such things as batteries or tools.

Figure 4:
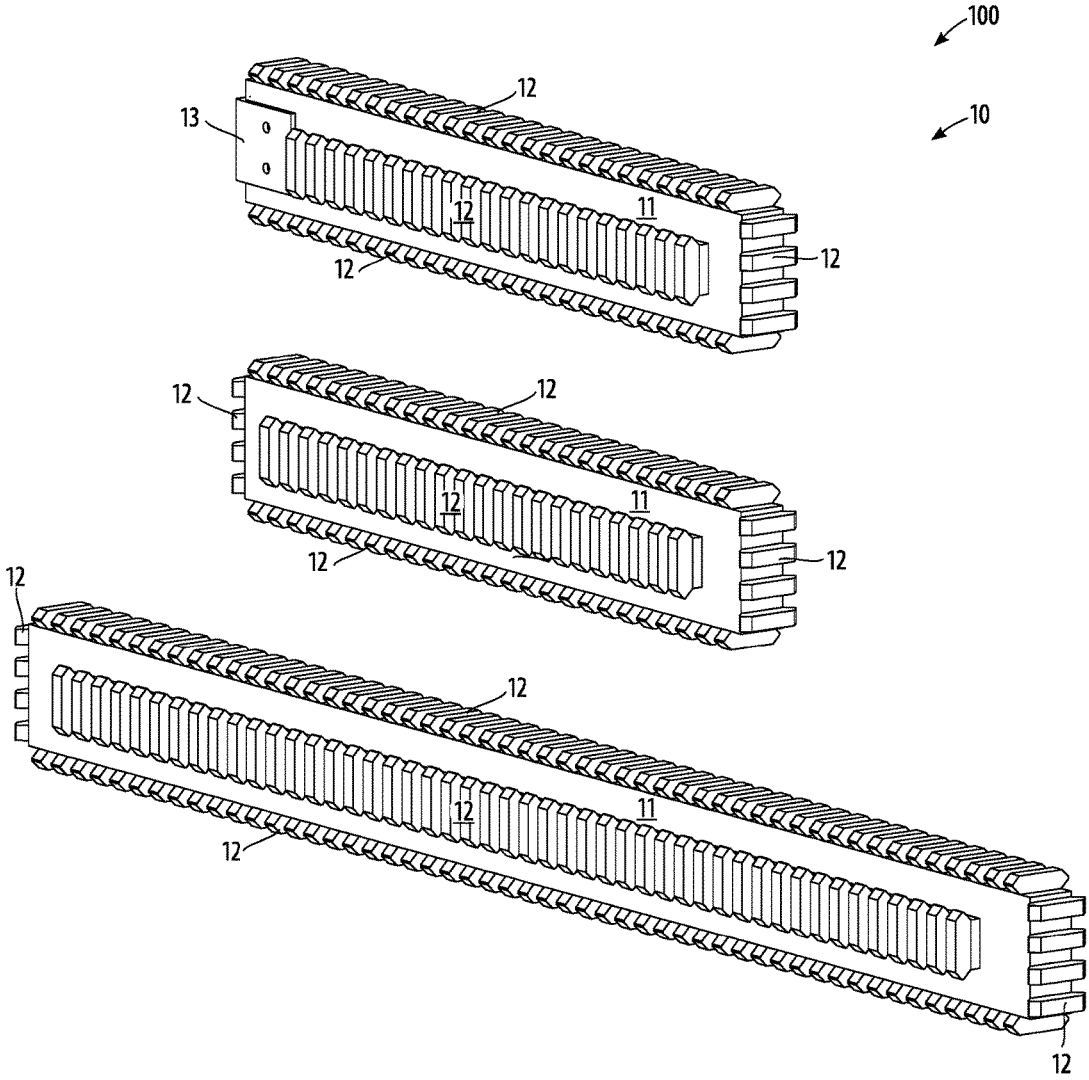
FIG. 4 is an orthographic view of embodiments of the tactical-gear rail-mounting system having rail-connector units mounted at right angles to the long sides.
Figure 8:
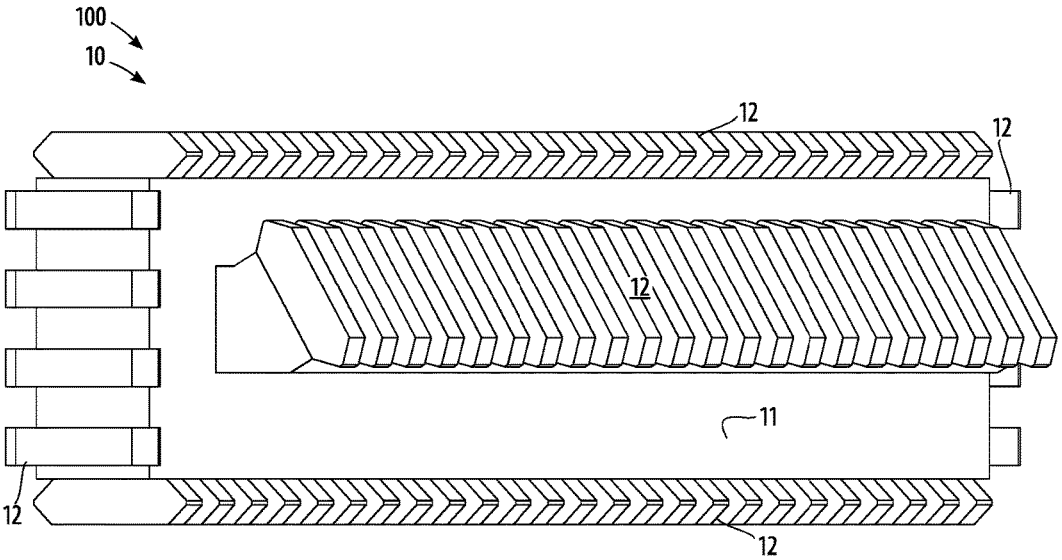
FIG. 8 is an orthographic view of an embodiment of the tactical-gear rail-mounting system having a rail-connector unit set at an angle in the transverse direction.

Referring now to FIG. 4, rail-connector units 12 can also be provided on one or both of the larger faces of the support body 11. Where this is provided, each such rail-connector unit 12 should be made to stand off the larger face by a spacer running along the bottom surface of the rail-connector unit, having dimensions of not greater than 0.617 of an inch or 15.6 millimeters by at least one-eighth or 0.13 of an inch or 3.3 millimeters. Optionally, these larger-face-mounted rail-connector units can be affixed at an angle other than a right angle to the top-mounted unit by using an angled stand-off spacer, as shown in FIG. 8.

Figure 5:
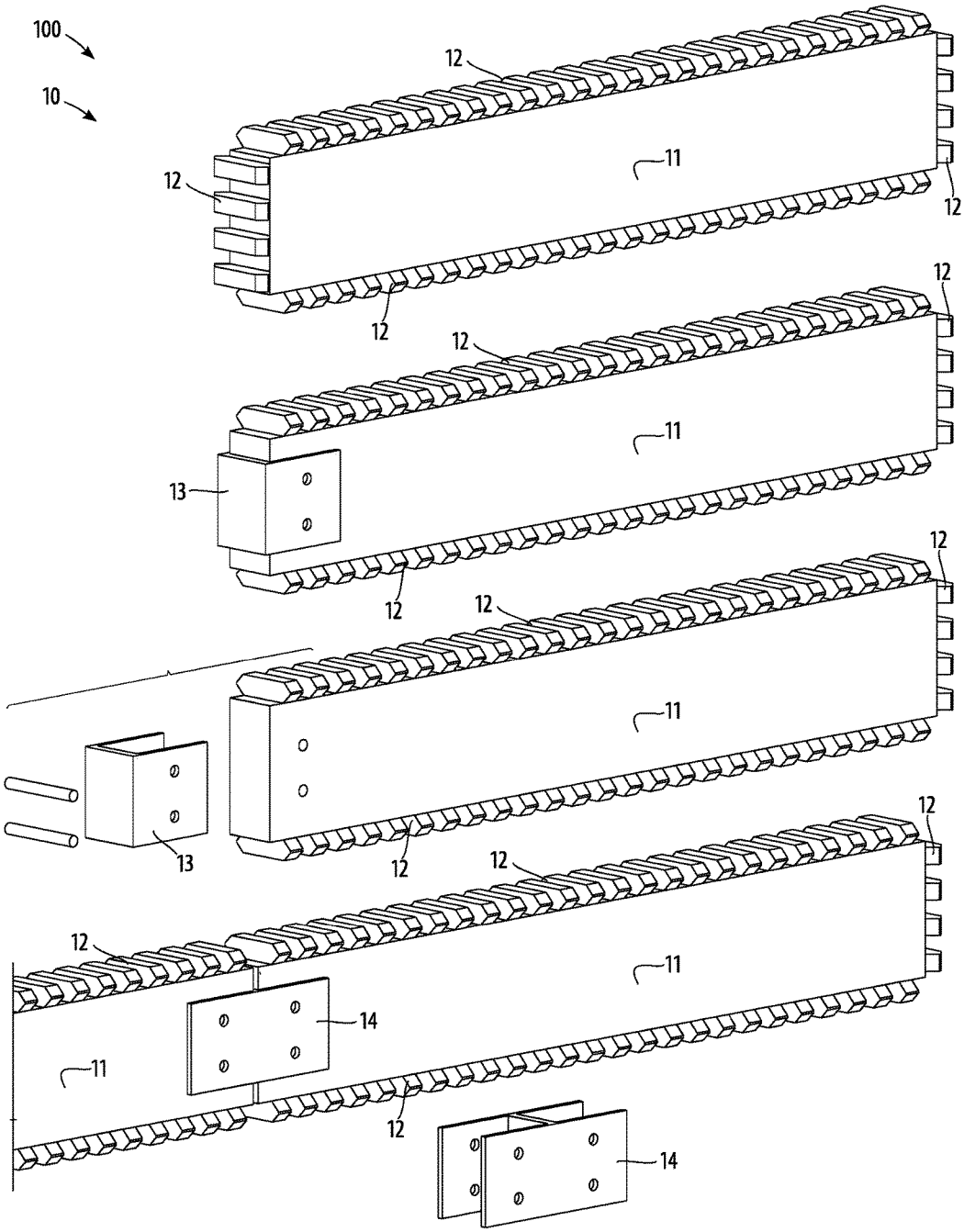
FIG. 5 is an orthographic, partially exploded and assembled view of embodiments of the tactical-gear rail-mounting system having attachment and dual-attachment units.

Referring now to FIG. 5, the tactical-gear rail-mounting system apparatus 10 can be attached to supporting gear such as a gun stock or grip by attachment at one of the rail-connector units 12. Alternatively, such attachment can be made through an attachment unit 13 in the form of a bracket or clip that secures to the support body 11 by standard fasteners such as screws, bolts, rivets, or pins, and then attaches to the supporting gear such as a gun stock by appropriate means. Two units of the tactical-gear rail-mounting system apparatus 10 can be attached together using a dual-attachment unit 14, as illustrated, which can be secured to the support bodies 11 by standard fasteners as above. Such an arrangement would be useful in supporting long, bending-prone gear, or pieces of gear that are placed some distance apart but must be held in alignment.

Figure 6:
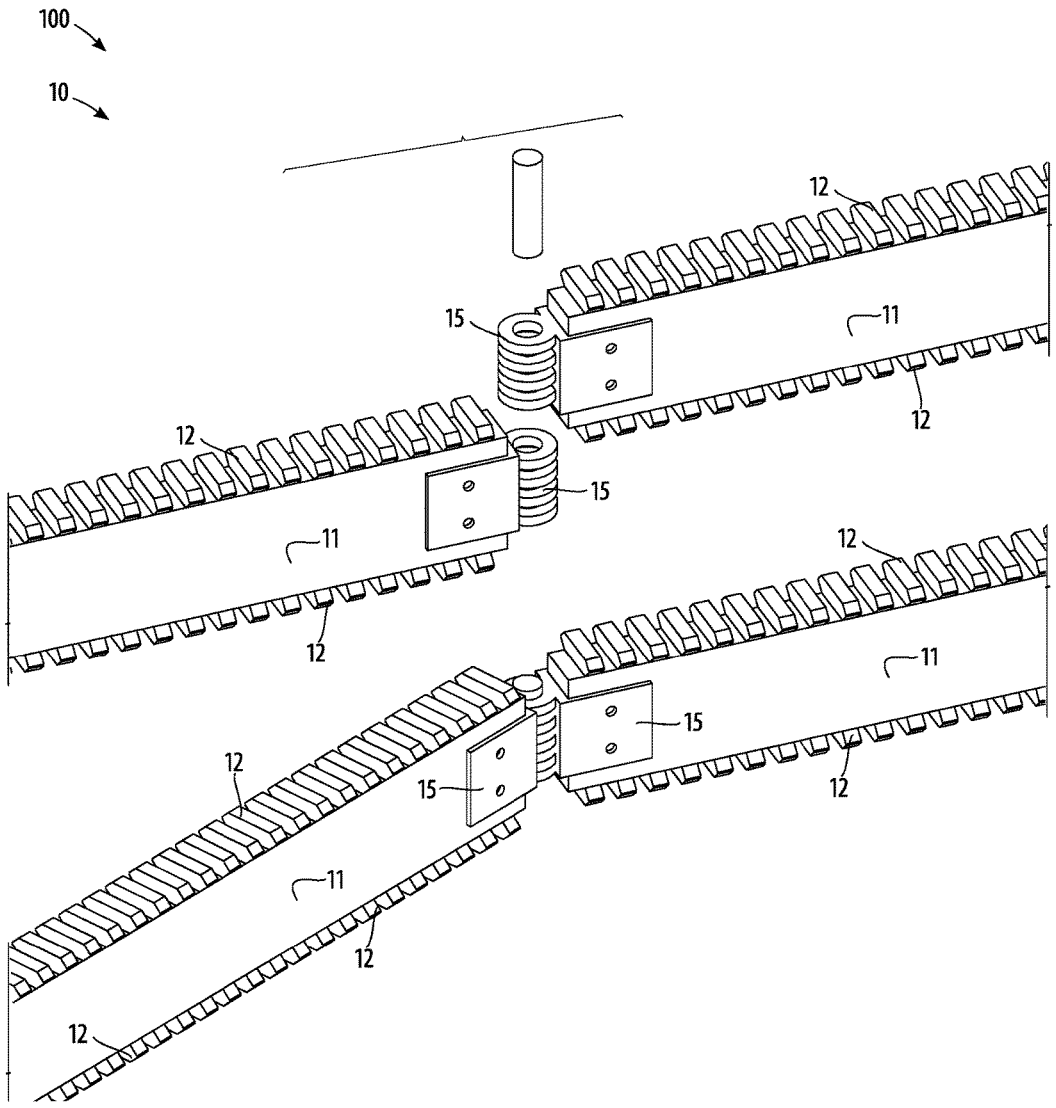
FIG. 6 is an orthographic, partially exploded and assembled view of an embodiment of the tactical-gear rail-mounting system having hinge-attachment units.

Referring now to FIG. 6, a hinged attachment of two units of the tactical-gear rail-mounting system apparatus 10 can be made using hinge-attachment units 15 fastened by and rotating about a standard fastener such as a pin. Such an arrangement would be useful in supporting pieces of tactical gear needing to be placed in varying angles to each other but otherwise be held in a planar alignment.

Suitable materials for making the tactical-gear rail-mounting system apparatus 10 are essentially the same range of materials used to manufacture tactical gear, which is machinable metals, composite materials, and hard plastics. Different components can be made of different materials. If it is desired to make an electrically conductive connection between two conductive pieces of gear, then electrically conductive material should be used. On the other hand, pieces of gear can be electrically isolated from each other with a tactical-gear rail-mounting system apparatus 10 constructed of non-conductive material.

The simplicity and interchangeability of the tactical-gear rail-mounting system provides benefits in the field. Auxiliary equipment can be swapped among or be borrowed from other gear. Connection and disconnection can be accomplished blindfolded in training and under challenging conditions in the field. Unusual configurations of auxiliary equipment tactical gear can be made in the field, without tools, in order to meet unusual circumstances.

Many changes and modifications can be made in the present invention without departing from the spirit thereof. I therefore pray that my rights to the present invention be limited only by the scope of the appended claims.

I claim:

1. A tactical-gear rail-mounting system apparatus for precise aligned removable mounting of a variety of tactical-gear auxiliary equipment, utilizing the Picatinny-rail standard, comprising:

(i) a support body having elongated sides and opposing ends, a nominal top edge formed along said elongated sides, and at least two additional edges, defining a polygon, and a depth generally perpendicular to the top edge, defining a polyhedron having a nominal forward-facing face and a backward-facing face, the depth of said support body not exceeding 0.617 of an inch or 15.6 millimeters at the one-eighth of an inch or 3.3 millimeters closest to the edges;

(ii) more than one rail-connector unit having an in-line direction and a transverse direction, and top and bottom faces, arrayed upon said support body in angular relationship one to the other such that all bottom faces face generally inward toward all other bottom faces; and (iii) a second support body, and a dual attachment unit detachably mounted between selected opposing ends of adjacent support bodies and secured to the forward-facing face and the backward-facing face of the support body;

where said rail-connector units arrayed upon said support body provide additional connection areas in defined and fixed angular relationship one to the other;

where a combined mounting area of the dual attachment unit and a variety of mounting-surface orientations are provided for precise aligned removable mounting of tactical-gear auxiliary equipment;

wherein the dual attachment unit comprises a hinged-attachment member adapted to attach two said adjacent support bodies together such that said support bodies can be moved in an angular relationship one to the other in one plane only, maintaining a fixed relationship in other planes; and wherein said hinged-attachment member comprises a first attachment plate secured to at least one face of the support body, a second attachment plate secured to the selected end of the support body, and a hinged assembly supported by the second attachment plate of each of the adjacent support bodies.

2. A tactical-gear rail-mounting system method for precise aligned removable mounting of a variety of tactical-gear auxiliary equipment, utilizing the Picatinny-rail standard, comprising:

(i) providing a tactical-gear rail-mounting system apparatus, comprising:

(a) a support body having elongated sides and opposing ends, a nominal top edge formed along said elongated sides, and at least two additional edges, defining a polygon, and a depth generally perpendicular to the top edge, defining a polyhedron having a nominal forward-facing face and backward-facing face, the depth of said support body not exceeding 0.617 of an inch or 15.6 millimeters at the one-eighth of an inch or 3.3 millimeters closest to the edges;

(b) more than one rail-connector unit having an in-line direction and a transverse direction, and top and bottom faces, arrayed upon said support body in angular relationship one to the other such that all bottom faces face generally inward toward all other bottom faces; and (c) a second support body, and a dual attachment unit detachably mounted between selected opposing ends of adjacent support bodies and secured to the forward-facing face and the backward-facing face of the support body;

where said rail-connector units arrayed upon said support body provide additional connection areas in defined and fixed angular relationship one to the other;

where a combined mounting area of the dual attachment unit and a variety of mounting-surface orientations are provided for precise aligned removable mounting of tactical-gear auxiliary equipment;

wherein the dual attachment unit comprises a hinged-attachment member adapted to attach two said adjacent support bodies together such that said support bodies can be moved in an angular relationship one to the other in one plane only, maintaining a fixed relationship in other planes; and wherein said hinged-attachment member comprises a first attachment plate secured to at least one face of the support body, a second attachment plate secured to the selected end of the support body, and a hinged assembly supported by the second attachment plate of each of the adjacent support bodies; and (ii) using said tactical-gear rail-mounting system apparatus for precise aligned removable mounting of a variety of tactical-gear equipment.

* * * * *